US012663166B2

(12) United States Patent
Matsui

(10) Patent No.: US 12,663,166 B2
(45) Date of Patent: Jun. 23, 2026

(54) HOT WATER CIRCULATION DEVICE AND HOT WATER DEVICE MONITORING SYSTEM

(71) Applicant: NORITZ CORPORATION, Hyogo (JP)

(72) Inventor: Nobuaki Matsui, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 923 days.

(21) Appl. No.: 17/965,778

(22) Filed: Oct. 14, 2022

(65) Prior Publication Data

US 2023/0128301 A1 Apr. 27, 2023

(30) Foreign Application Priority Data

Oct. 22, 2021 (JP) ..... 2021-172902

(51) Int. Cl.

| | |
|---|---|
| ***F24D 17/00*** | (2022.01) |
| ***F24D 11/00*** | (2022.01) |
| ***F24D 19/10*** | (2006.01) |
| ***F24H 1/18*** | (2022.01) |

(52) U.S. Cl.

CPC ..... *F24D 17/0078* (2013.01); *F24D 11/002* (2013.01); *F24D 19/1015* (2013.01); *F24H 1/188* (2013.01)

(58) Field of Classification Search

CPC .... F24D 17/0078; F24D 17/02; F24D 11/002; F24D 19/1015; F24D 19/1051; F24H 1/188; F24H 1/18; F24H 9/2007; F24H 9/2021

See application file for complete search history.

(56) References Cited

U.S. PATENT DOCUMENTS

| | | | | |
|---|---|---|---|---|
| 2,395,583 A * | 2/1946 | Saco, Jr. | ..... | F02G 5/02 122/452 |
| 2014/0202543 A1* | 7/2014 | Abbing | ..... | E03B 7/045 137/625.48 |
| 2015/0040595 A1* | 2/2015 | Tamaki | ..... | F24D 17/001 62/159 |

(Continued)

FOREIGN PATENT DOCUMENTS

| | | |
|---|---|---|
| JP | 4869133 | 2/2012 |

*Primary Examiner* — Patrick C Williams
(74) *Attorney, Agent, or Firm* — JCIPRNET

(57) ABSTRACT

The disclosure includes a hot water circulation device, and a hot water device monitoring system including a circulation passage; a circulation pump circulating hot water in the circulation passage; a closed expansion tank in which a water chamber communicating with the circulation passage and an air chamber filled with a predetermined pressure in initial state are partitioned by a diaphragm; and a control unit controlling hot water circulation. The hot water circulation device includes an air chamber pressure sensor detecting pressure in the air chamber; a closing valve cutting off water chamber from the circulation passage; and an open valve opening to atmosphere from between closing valve and water chamber. The control unit closes closing valve and opens opening valve during hot water circulation, detects pressure in the air chamber by the air chamber pressure sensor, and issues a warning notification when the pressure is not within predetermined pressure range.

5 Claims, 5 Drawing Sheets

(56) References Cited

U.S. PATENT DOCUMENTS

| | | | | |
|---|---|---|---|---|
| 2016/0061508 | A1* | 3/2016 | Lowrimore | F24H 4/06 62/160 |
| 2018/0195763 | A1* | 7/2018 | Sarkis, Sr. | F24H 4/04 |
| 2020/0025488 | A1* | 1/2020 | Alicea, Jr. | F41A 17/22 |
| 2020/0318861 | A1* | 10/2020 | Kikuchi | F24H 9/2007 |

* cited by examiner

HOT WATER CIRCULATION DEVICE AND HOT WATER DEVICE MONITORING SYSTEM

CROSS-REFERENCE TO RELATED APPLICATION

This application claims the priority benefits of Japanese application no. 2021-172902, filed on Oct. 22, 2021. The entity of the above-mentioned patent application is hereby incorporated by reference herein and made a part of this specification.

BACKGROUND

Technical Field

The disclosure relates to a hot water circulation device that circulates hot water heated by a heat source machine in a circulation passage, and more particularly to a hot water circulation device that includes an expansion tank that absorbs a pressure rise in the circulation passage due to thermal expansion of hot water.

Related Art

Conventionally, an instant hot water circulation system that circulates hot water through a circulation passage while maintaining the temperature is used in lodging facilities and bathing facilities, for example, for an instant hot water function in which hot water is immediately supplied when a hot water tap is opened. The instant hot water circulation system includes a heat source machine that heats hot water and a hot water circulation device that circulates the heated hot water through a circulation passage.

The heat source machine uses a multi-hot water supply system capable of supplying a large amount of hot water by connecting a plurality of hot water supply devices in parallel so as to be handle simultaneous hot water simultaneously supply from a plurality of hot water taps. The multi-hot water supply system is configured to heat by changing the number of operating units according to the amount of heat required so as to be able to supply even a small amount of hot water. The hot water circulation device drives a circulation pump to constantly circulate the hot water heated by the heat source machine through the circulation passage. Moreover, when hot water is supplied from the hot water tap, tap water corresponding to the amount of hot water supplied is supplied from a tap water source to the circulation passage.

When tap water is heated, its volume increases (thermal expansion). On the other hand, the circulation passage is also warmed by the heated hot water and thermally expands, but the amount of expansion is slight compared to the tap water. Therefore, if the pressure in the circulation passage (circulation pressure) rises and exceeds the allowable pressure, for example, hot water may leak from a piping connection portion of the circulation passage, or equipment installed therein may be damaged. In order to prevent such leakage and damage, the circulation passage is equipped with a closed expansion tank that temporarily stores a portion of the hot water with increased volume and absorbs the pressure rise in the circulation passage.

The inside of the closed expansion tank is partitioned into an air chamber and a water chamber by, for example, a flexible synthetic resin diaphragm. The air chamber is filled with a gas such as air or nitrogen at a pressure higher than the atmospheric pressure. A water chamber is connected so as to communicate with the circulation passage. If the diaphragm of this closed expansion tank is damaged or gas escapes from a filling port of the air chamber and the pressure rise in the circulation passage cannot be absorbed, failures such as hot water leakage and equipment damage may occur.

To prevent such failures, for example, there is known a technique of inspection by measuring the pressure in the air chamber when the pressure in the water chamber is changed after both the water chamber and the air chamber are brought to the atmospheric pressure, such as the pressure sensor provided with a water chamber and an air chamber partitioned by a diaphragm in Patent Literature 1 (JP 4869133).

However, in Patent Literature 1, the water chamber is part of the circulation passage, and the flow of the circulating liquid is restricted or stopped for inspection. When this technique is applied to an instant hot water circulation system, the circulation of hot water is stopped before the inspection, and the instant hot water circulation system cannot be used during the inspection, so inspections are performed periodically every year, for example. In this case, the gas in the air chamber may escape during a long period until the next inspection. Therefore, it is difficult to foresee failures caused by the expansion tank, and there have been cases in which countermeasures have to be taken after the failures occur.

The disclosure provides a hot water circulation device capable of preventing the occurrence of failure caused by an expansion tank by measuring the pressure in an air chamber of a closed expansion tank without stopping the circulation and detecting the failure of the expansion tank.

SUMMARY

A hot water circulation device of the disclosure of technical solution 1 includes a circulation passage for heated hot water; a circulation pump for circulating the hot water in the circulation passage; a closed expansion tank in which a water chamber communicating with the circulation passage and an air chamber filled to a predetermined pressure in an initial state are partitioned by a diaphragm; and a control unit for controlling the circulation of the hot water. The hot water circulation device includes an air chamber pressure sensor for detecting a pressure in the air chamber of the expansion tank; a closing valve for cutting off the water chamber from the circulation passage; and an opening valve capable of opening to an atmosphere from between the closing valve and the water chamber. The control unit closes the closing valve and opens the opening valve during circulation of the hot water, detects the pressure in the air chamber by the air chamber pressure sensor, and issues a warning notification when the pressure in the air chamber is not within a predetermined pressure range.

In the hot water circulation device of the disclosure of technical solution 2 according to the disclosure of technical solution 1, the control unit includes a data storage unit for storing the pressure in the air chamber measured periodically, compares a pressure measured this time with a previous pressure stored in the data storage unit, and issues a warning notification when the difference is equal to or higher than a predetermined value.

In the hot water circulation device of the disclosure of technical solution 3 according to the disclosure of technical solution 1 or 2, the control unit lowers a temperature of the hot water in the circulation passage and continues a circulation when issuing the warning notification.

A hot water device monitoring system of the disclosure of technical solution 4 includes the disclosure of the hot water circulation device of technical solution 1 and a monitoring server. The control unit of the hot water circulation device is communicably connected to the monitoring server via a communication network, transmits the detected pressure of the air chamber to the monitoring server, and accumulates it in the monitoring server as pressure data. The control unit or the monitoring server instructs a service shop to inspect the expansion tank based on the pressure data when the pressure in the air chamber is not within the pressure range.

EMBODIMENT OF THE DISCLOSURE

According to the configuration, since the pressure in the air chamber is measured with the closing valve closed and the opening valve open, the pressure in the air chamber may be measured with the expansion tank disconnected from the hot water in the circulation passage without interfering with the circulation of hot water. Moreover, a warning notification is issued when the measured pressure is not within a predetermined pressure range. As a result, since the circulation of hot water is not interfered, the chances of measuring the pressure in the air chamber can be easily increased, and by detecting the failure of the expansion tank, the occurrence of failure caused by the expansion tank can be prevented.

According to the configuration, when the pressure in the air chamber fluctuates so rapidly that the difference exceeds a predetermined value, it means that the pressure in the air chamber has suddenly decreased, so it is assumed that the diaphragm is damaged or a filling port is open. Therefore, when the difference between the pressure at the time of the previous measurement and the pressure at this time is equal to or higher than a predetermined value, a warning notification may be issued to notify the occurrence of failure in the expansion tank.

According to the configuration, when the expansion tank cannot absorb the pressure in the hot water in the circulation passage because the pressure in the air chamber is not within the predetermined pressure range or because the pressure in the air chamber suddenly drops, the temperature of hot water in a circulation passage is lowered to continue circulation. As a result, since the temperature of hot water is lowered, the pressure in the circulation passage may be lowered, and failures such as leakage of hot water and damage of the circulation passage caused by the expansion tank can be prevented without interfering the use of hot water supply.

According to the configuration, the measured pressure of the air chamber is accumulated in the monitoring server as pressure data. Moreover, the control unit or the monitoring server instructs a service shop in charge to inspect the expansion tank based on this accumulated pressure data when the pressure in the air chamber is not within the predetermined pressure range, thereby enabling a quick response.

According to the hot water circulation device of the disclosure, it is possible to measure the pressure in the air chamber of the closed expansion tank without stopping the circulation, thereby detecting signs of failure of the expansion tank.

Figure 1:
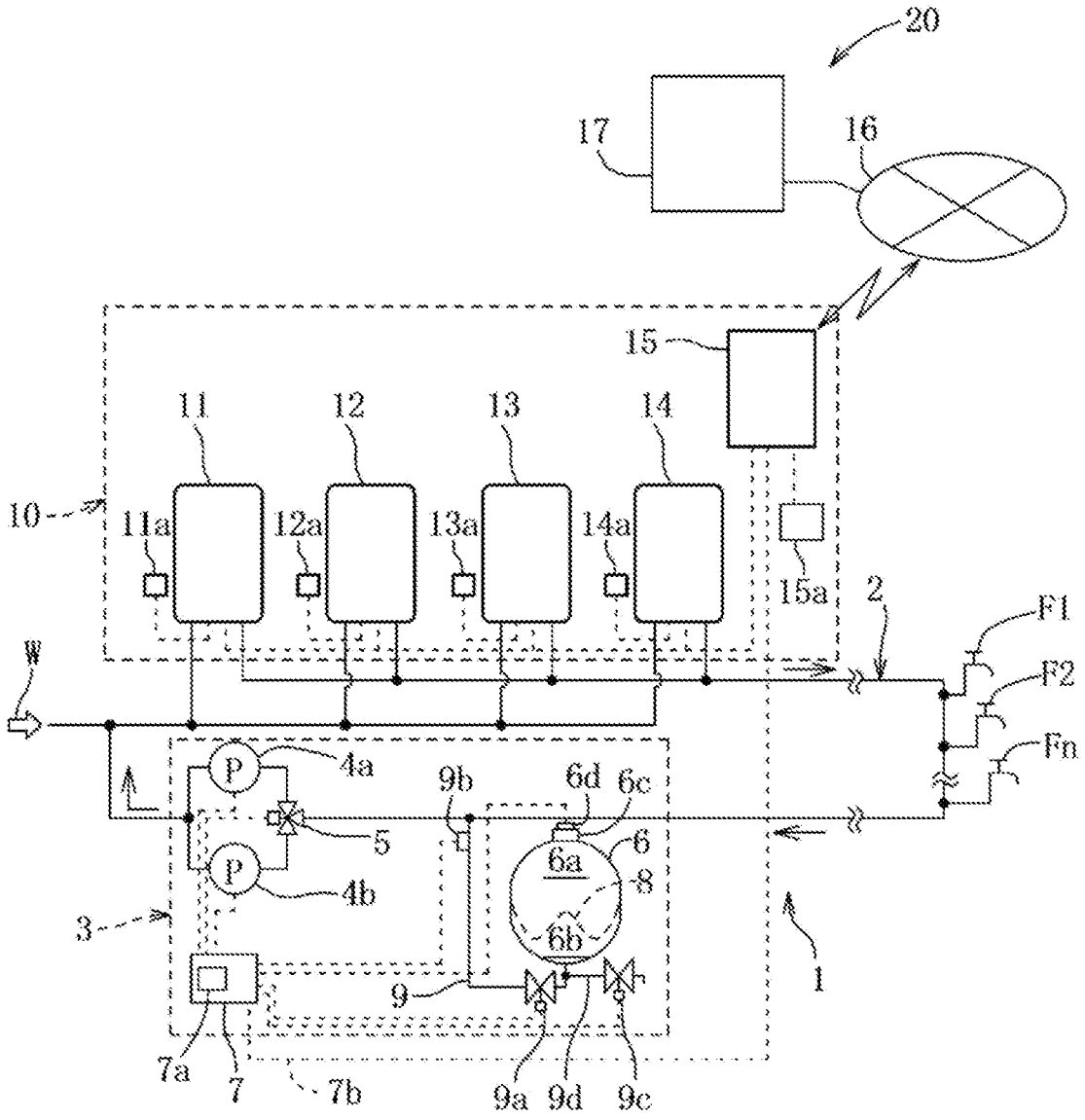
FIG. 1 is a diagram showing an instant hot water circulation system equipped with a hot water circulation device according to an embodiment of the disclosure.

Hereinafter, the aspects for implementing this disclosure is illustrated based on an embodiments First, an instant hot water circulation system will be described with reference to FIG. 1.

An instant hot water circulation system 1 includes a multi-hot water supply system 10 composed of a plurality (for example, four) of hot water supply devices 11-14 as heat source machine for heating hot water, and a hot water circulation device 3 for circulating hot water heated by the multi-hot water supply system 10 through a circulation passage 2 provided with a plurality of hot water taps F1-Fn.

The multi-hot water supply system 10 includes a control device 15 for controlling the number of operating units of the plurality of hot water supply devices 11-14. The plurality of hot water supply devices 11-14 respectively include operation remote controllers 11*a*-14*a*, for example, for individually setting the hot water supply devices 11-14. The control device 15 includes, for example, an operation remote controller 15*a* for setting the multi-hot water supply system 10. The control device 15 is connected to a communication network 16 (internet) via a wireless or wired communication line, for example, may communicate information about the instant hot water circulation system 1 such as operation data and error occurrence with a monitoring server 17 connected to the communication network 16. Thus, a hot water device monitoring system 20 in which the monitoring server 17 monitors the hot water circulation device 3 and the multi-hot water supply system 10 is configured. The monitoring server 17 is a computer equipped with an arithmetic unit, a storage device, and the like, receiving operation data of the plurality of hot water supply devices, the hot water supply system, and the like, and monitoring their states.

The hot water supply devices 11-14 are connected in parallel such that tap water is supplied to the circulation passage 2 from a tap water source as indicated by an arrow W and heated hot water may be supplied from any of the hot water supply devices 11-14 to the plurality of hot water taps F1-Fn. For example, when the hot water tap F1 is opened, hot water heated by one or more hot water supply devices (for example, the hot water supply device 11) selected to operate by the control device 15 is supplied to the hot water tap F1.

Next, the hot water circulation device 3 will be explained.

The hot water circulation device 3 is interposed in the circulation passage 2 for supplying hot water heated by the multi-hot water supply system 10 to the multi-hot water supply system 10 again. This hot water circulation device 3 includes two circulation pumps 4*a* and 4*b* for circulating hot water, a three-way valve 5 for switching hot water flow paths; a closed expansion tank 6 for absorbing pressure rise in the circulation passage 2 due to thermal expansion of the heated hot water; and a control unit 7 for controlling the circulation of hot water.

The control unit 7 switches the three-way valve 5 to alternately drive the two circulation pumps 4*a* and 4*b* so as to equalize the drive loads of the circulation pumps 4*a* and 4*b*. Since the hot water circulation device 3 includes the two circulation pumps 4*a* and 4*b*, even if one fails, the other may be driven to circulate heated hot water at all times. The control unit 7 includes a data storage unit 7*a*, and is communicably connected to the control device 15 via a communication line 7*b* so as to cooperate with the control device 15 of the multi-hot water supply system 10 to control the circulation of hot water.

The inside of the closed expansion tank 6 is partitioned into an air chamber 6*a* and a water chamber 6*b* by a flexible diaphragm 8 made of synthetic resin, for example. In the initial state, the air chamber 6*a* is filled with a gas such as air or nitrogen from a filling port 6*c* at a predetermined initial filling pressure, and the filling port 6*c* is closed such that the gas does not leak out. The filling port 6*c* is equipped with an air chamber pressure sensor 6*d* for detecting the pressure in the air chamber 6*a*, and the detected pressure is transmitted to the control unit 7.

The water chamber 6*b* is connected to the circulation passage 2 via a connection passage 9 so as to communicate therewith. The connection passage 9 is equipped with a closing valve 9*a* capable of closing the connection passage 9. The closing valve 9*a* is normally in an open state, and the water chamber 6*b* and the circulation passage 2 are communicated with each other.

A circulation pressure sensor 9*b* for detecting the pressure in hot water in the circulation passage 2 (circulation pressure) is provided closer to the circulation passage 2 side of the connection passage 9 than the closing valve 9*a*, and the detected pressure is transmitted to the control unit 7. From between the closing valve 9*a* of the connection passage 9 and the water chamber 6*b*, an open passage 9*d* provided with an opening valve 9*c* is connected so as to be able to be open to the atmosphere. The opening valve 9*c* is normally closed. Moreover, the circulation pressure sensor 9*b* may also be installed in the circulation passage 2.

The instant hot water circulation system 1 starts circulation in a state in which the circulation passage 2 and hot water passages of the multi-hot water supply system 10 are filled with tap water (filled with water). In this filled state, the diaphragm 8 of the closed expansion tank 6 is deformed along the inner wall of the water chamber 6*b* by the initial filling pressure of the air chamber 6*a* in the initial state, and the water chamber 6*b* is hardly willed with tap water.

When the control unit 7 drives, for example, the circulation pump 4*a* to start circulation of hot water, and heating is started in the multi-hot water supply system 10 so as to reach a predetermined circulation target temperature. Since the heated hot water thermally expands, the pressure in the circulation passage 2 rises more than when filled with water. The closed expansion tank 6 introduces part of the thermally expanded hot water into the water chamber 6*b* to absorb the pressure rise in the circulation passage 2. At this time, since the air chamber 6*a* is filled with gas, the diaphragm 8 is deformed such that the pressure in the air chamber 6*a* and the pressure in the water chamber 6*b* are balanced.

When hot water is supplied from the hot water taps F1-Fn, the hot water introduced into the water chamber 6*b* returns to the circulation passage 2 and is heated by the multi-hot water supply system 10 together with the supplied tap water to be supplied. When the supply of hot water from the hot water taps F1-Fn ends, hot water in an amount corresponding to thermal expansion caused by heating in order to maintain the temperature of the circulating hot water is introduced into the water chamber 6*b*.

The gas in the air chamber 6*a* may gradually escape from the filling port 6*c* to the outside or from the diaphragm 8 to the water chamber side, and the pressure in the air chamber 6*a* gradually decreases from the initial filling pressure over time. Since the circulation pressure of hot water basically does not change over time, when the pressure in the air chamber 6*a* and the pressure in the water chamber 6*b* are balanced, the diaphragm 8 is pushed toward the air chamber 6*a* side as the pressure in the air chamber 6*a* decreases, and the volume of the air chamber 6*a* decreases. Ultimately, the water chamber 6*b* cannot absorb the thermal expansion of the hot water, and the circulation pressure in the circulation passage 2 increases, which may cause leakage and damage.

Figure 2:
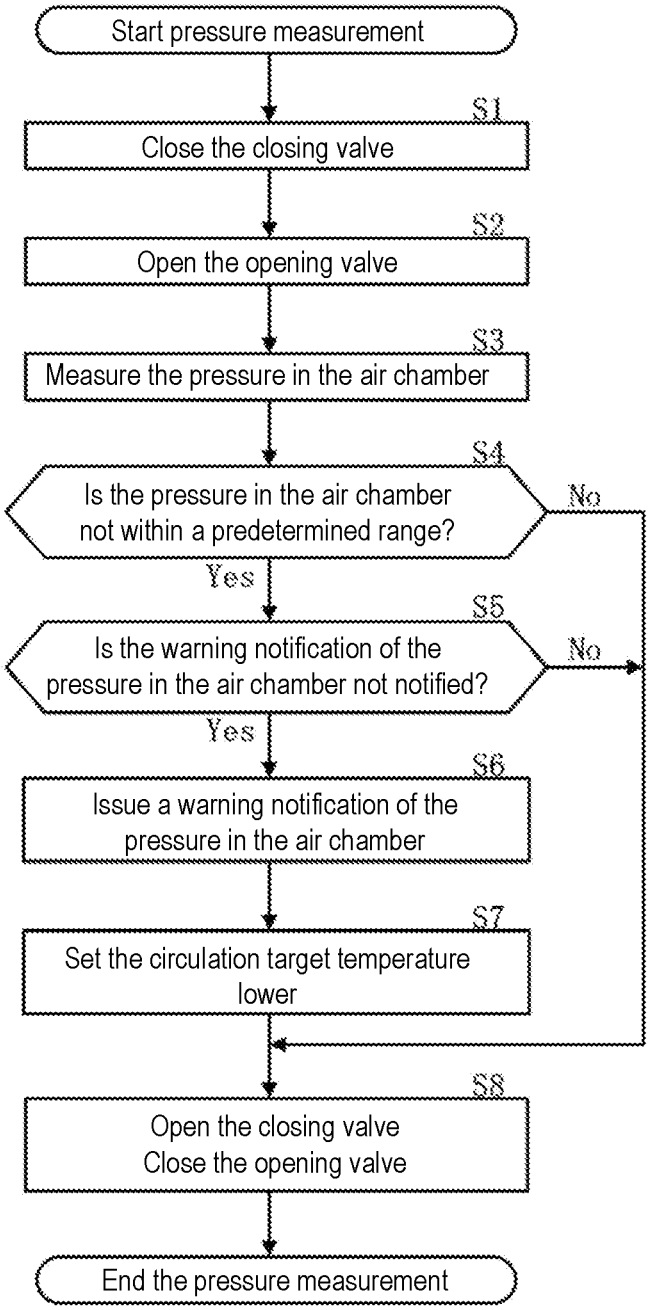
FIG. 2 is a flow chart showing an example of air chamber pressure measurement.

In order to prevent such leakage and damage, the pressure in the air chamber 6*a* is measured periodically (for example, once a day) without stopping circulation, and a warning notification is issued when an abnormality in the pressure in the air chamber 6*a* or an abnormality in pressure fluctuation in the air chamber 6*a* is detected. A user of the instant hot water circulation system 1 who finds an abnormality in the pressure in the air chamber 6*a* or an abnormality in pressure fluctuation may request inspection and maintenance of the expansion tank 6, and take measures such as refilling the air chamber 6*a* with gas before leakage or damage occurs. The pressure measurement of the air chamber 6*a* periodically performed by the control unit 7 will be described based on the flow chart of FIG. 2. Si (i=1, 2, 3, . . . ) in the figure represents steps.

For example, at a predetermined measurement time, pressure measurement of the air chamber 6*a* is started. First, in S1, the closing valve 9*a* that is normally open during the circulation operation is closed, and the process proceeds to S2. When the closing valve 9*a* is closed, the connection passage 9 for communicating the circulation passage 2 with the water chamber 6*b* is closed, so the flow of hot water between the circulation passage 2 and the expansion tank 6 is cut off.

In S2, the opening valve 9*c* that is normally closed during the circulation operation is opened, and the process proceeds to S3. Since the opening valve 9*c* is opened, hot water in the water chamber 6*b* is discharged to the outside through the open passage 9*d* and the pressure in the water chamber 6*b* becomes atmospheric pressure, and the diaphragm 8 is pushed toward the water chamber 6*b* side so as to balance with the atmospheric pressure according to the pressure in the air chamber 6*a*. When there is sufficient pressure in the air chamber 6*a*, the volume of the water chamber 6*b* becomes substantially zero.

In S3, the pressure in the air chamber 6*a* is measured by the air chamber pressure sensor 6*d*, and the process proceeds to S4. Next, in S4, it is determined whether or not the measured pressure is within a predetermined pressure range set to, for example, the initial filling pressure or lower and half of the initial filling pressure or higher. When a sufficient amount of gas remains in the air chamber 6*a*, a pressure equal to or lower than the initial filling pressure and equal to or higher than half the initial filling pressure is detected. Further, the initial filling pressure is equal to or higher than the water supply pressure of tap water, and half the initial filling pressure is higher than the atmospheric pressure.

If the determination in S4 is YES, the process proceeds to S5, and in S5, it is determined whether or not the warning notification of the pressure in the air chamber 6*a* is not notified. If the determination in S5 is YES, the process proceeds to S6, and in S6, a warning notification of the pressure in the air chamber 6*a* is issued, and the process proceeds to S7. The warning notification of the pressure in the air chamber 6*a* is notified by display means (not shown) such as a lamp or a display provided in the hot water circulation device 3, or voice output means. Further, the notification may also be given by display or voice output from the operation remote controller 15*a* of the control device 15 that is communicatively connected.

In S7, the circulation target temperature is set lower by, for example, 5° C. as a predetermined temperature than the current temperature, and the process proceeds to S8. The control unit 7 commands the control device 15 to set the circulation target temperature lower than the current temperature, and the control device 15 causes the hot water supply devices 11-14 to lower the circulation target temperature of the hot water supplied to the circulation passage 2.

Finally, in S8, the closing valve 9*a* closed for pressure measurement of the air chamber 6*a* is opened and the opened opening valve 9*c* is closed to restore the function of the expansion tank 6 to absorb the pressure rise of the hot water in the circulation passage 2 and end the pressure measurement of the air chamber 6*a*. On the other hand, if the determination in S4 is No, or if the determination in S5 is No, the process also proceeds to S8, and in S8, the closing valve 9*a* closed for pressure measurement of the air chamber 6*a* is opened and the opening valve 9*c* is closed so as to end the pressure measurement of the air chamber 6*a*.

Figure 3:
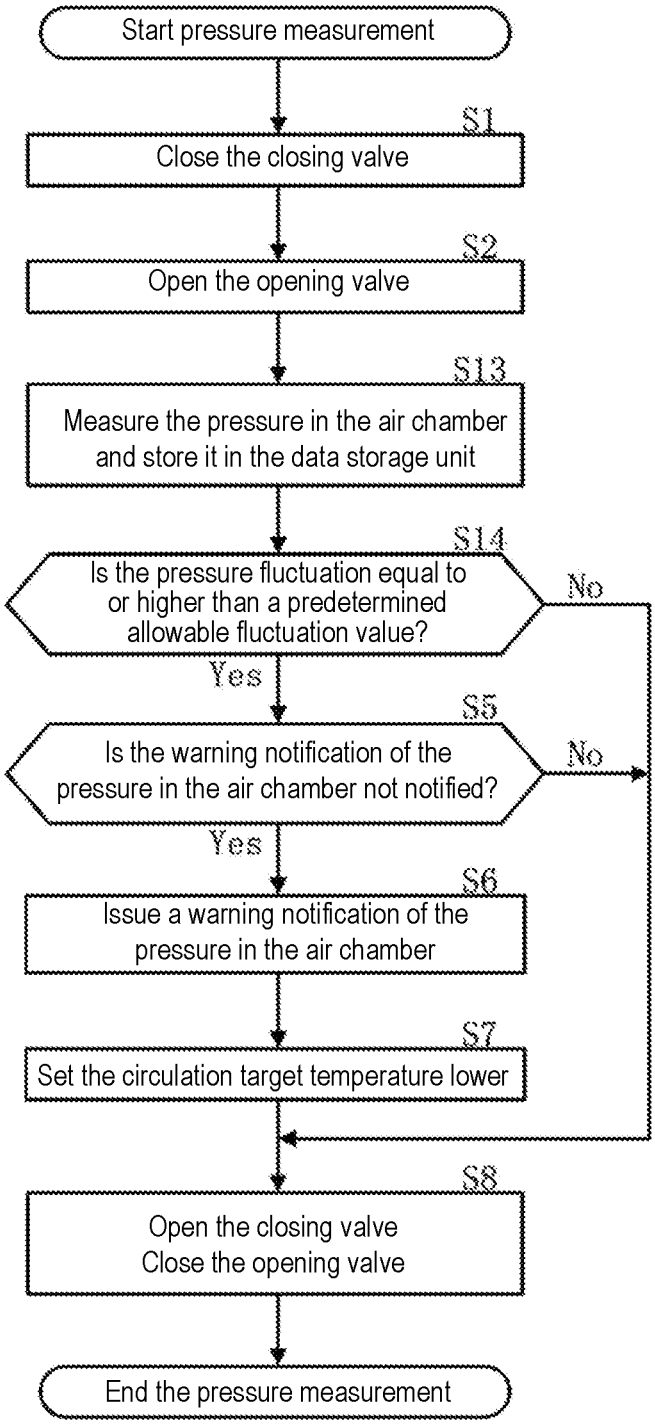
FIG. 3 is a flow chart showing another example of air chamber pressure measurement.

Another example of pressure measurement of the air chamber 6*a* will be described with reference to FIG. 3. S1 and S2 are the same as in FIG. 2: the closing valve 9*a* is closed and the opening valve 9*c* is opened, and the process proceeds to S13. In S13, the pressure in the air chamber 6*a* measured is stored in the data storage unit 7*a* of the control unit 7, and the process proceeds to S14. Next, in S14, it is determined whether or not the difference (pressure fluctuation) between the pressure measured last time and the pressure measured this time stored in the data storage unit 7*a* is, for example, equal to or higher than a predetermined allowable fluctuation value. The allowable fluctuation value is set in advance to a value that does not lose the pressure rise absorption function within the service life of the expansion tank 6, for example.

If the determination in S14 is Yes, the process proceeds to S5. If the determination in S14 is No, the process proceeds to S8. S5 to S8 are the same as those in FIG. 2 already described, description thereof will be omitted. Sudden pressure fluctuations exceeding the allowable fluctuation value may indicate that the filling port 6*c* of the air chamber 6*a* is open or the diaphragm 8 is damaged, so a warning notification of the pressure in the air chamber 6*a* is issued to urge a countermeasure.

Figure 4:
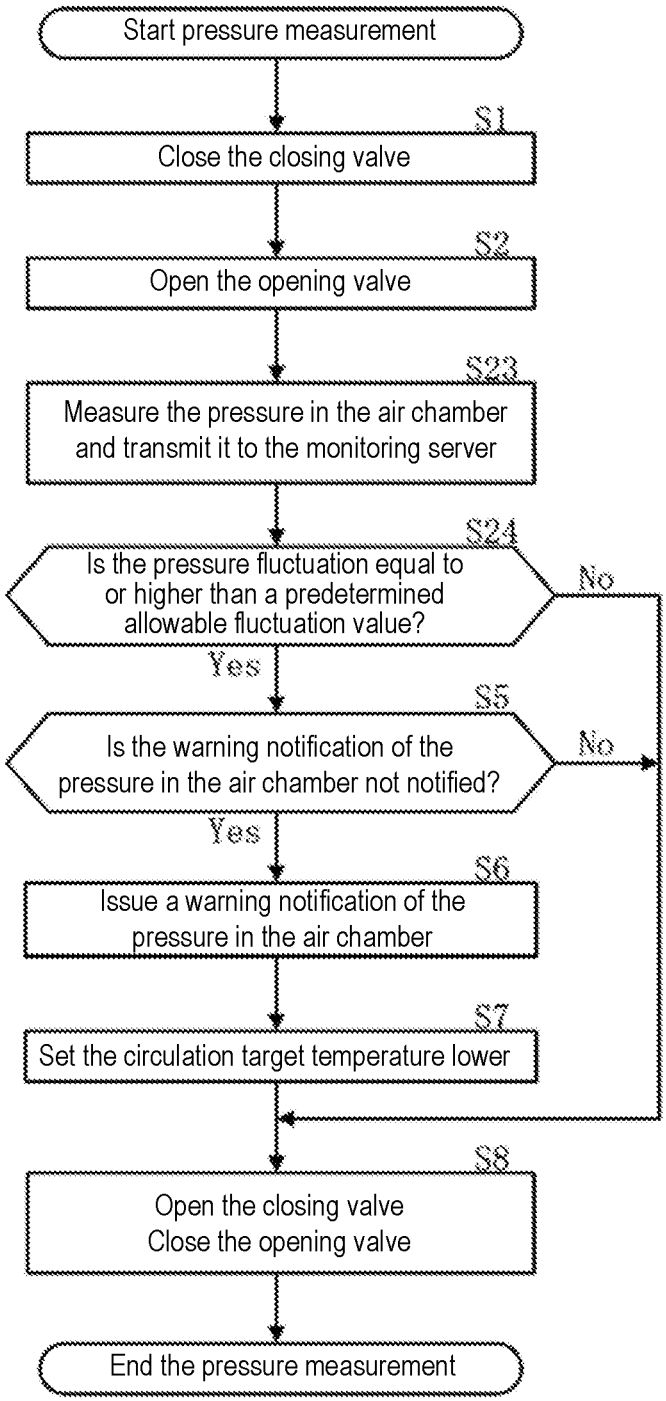
FIG. 4 is a flow chart showing an example of air chamber pressure measurement of a hot water circulation device.

An example of pressure measurement of the air chamber 6*a* when the control unit 7 is communicably connected to the monitoring server 17 via the control device 15 and the communication network 16 will be described with reference to FIG. 4. S1 and S2 are the same as in FIGS. 2 and 3: the closing valve 9*a* is closed and the opening valve 9*c* is opened, and the process proceeds to S23. In S23, the pressure in the air chamber 6*a* is measured, the pressure in the air chamber 6*a* is transmitted to the monitoring server 17, and the process proceeds to S24. The monitoring server 17 accumulates the received pressure of the air chamber 6*a* as pressure data in a storage device (not shown).

In S24, it is determined whether or not the difference (pressure fluctuation) between the pressure measured last time and the pressure measured this time is, for example, equal to or higher than a predetermined allowable fluctuation value. The allowable fluctuation value is set in advance to a value that does not lose the pressure rise absorption function within the service life of the expansion tank 6, for example. For the determination in S24, the control unit 7 may acquire the pressure at the time of the previous measurement from the monitoring server 17 and comparing it with the pressure measured this time at each transmission opportunity of the pressure in the air chamber 6*a*, or the monitoring server 17 may compare the pressure measured last time with the pressure measured this time based on the accumulated pressure data.

If the determination in S24 is Yes, the process proceeds to S5, and if the determination in S24 is No, the process proceeds to S8. S5 to S8 are the same as those in FIGS. 2 and 3 already described, description thereof will be omitted. Moreover, in S6, a warning notification of the pressure in the air chamber 6*a* may also be given to the hot water circulation device 3, and a service shop in charge of the hot water circulation device 3 may be instructed from the monitoring server 17 to inspect the expansion tank 6 so as to respond quickly.

Figure 5:
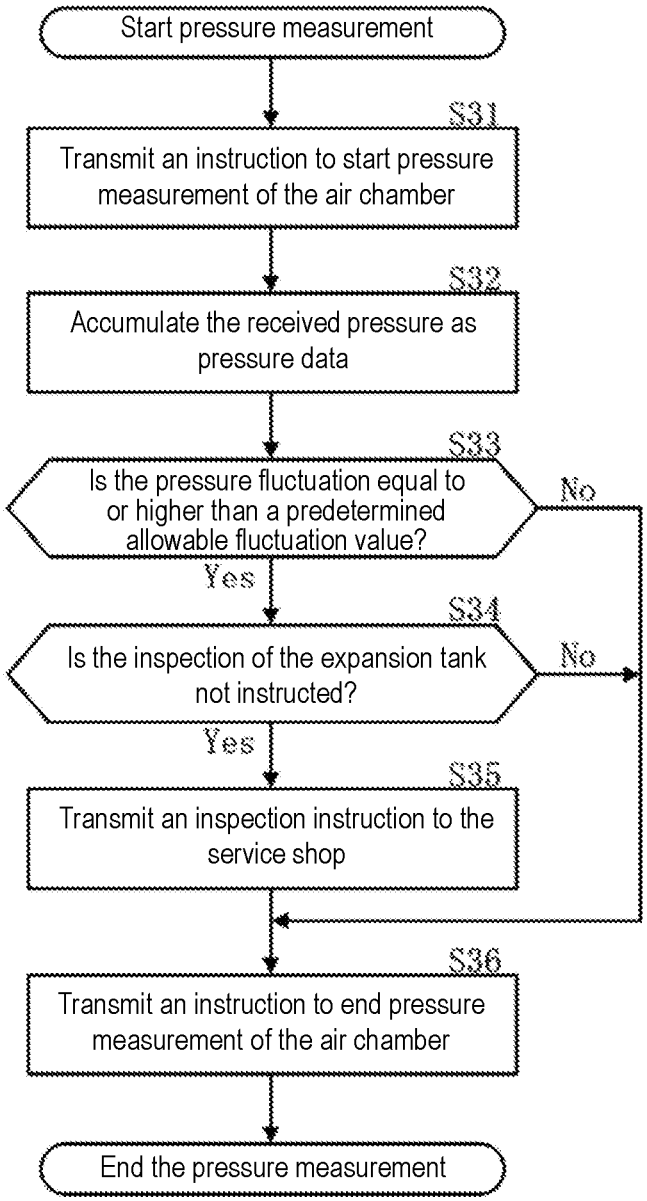
FIG. 5 is a flow chart of air chamber pressure measurement by a monitoring server of a hot water device monitoring system.

When the control unit 7 is connected to the monitoring server 17 via the control device 15 and the communication network 16 to configure the hot water device monitoring system 20, at a predetermined measurement time, the monitoring server 17 may also be configured to instruct the control unit 7 to measure the pressure in the air chamber 6*a*, for example. For example, as shown in FIG. 5, at a predetermined measurement time, an instruction to start pressure measurement of the air chamber 6*a* is transmitted to the control unit 7 in S31, and the process proceeds to S32. Upon receiving the instruction so as to start pressure measurement of the air chamber 6*a*, the control unit 7 closes the closing valve 9*a* and opens the opening valve 9*c* to measure the pressure in the air chamber 6*a* as described, and transmits the measured pressure to the monitoring server 17. In S32, the monitoring server 17 accumulates the received pressure as pressure data, and the process proceeds to S33.

In S33, based on the accumulated pressure data, the monitoring server 17 determines whether or not the difference (pressure fluctuation) between the pressure measured this time and the pressure measured last time is, for example, equal to or higher than a predetermined allowable fluctuation value. If the determination in S33 is YES, the process proceeds to S34, and in S34, it is determined whether or not the inspection of the expansion tank 6 is not instructed to the service shop in charge of the hot water circulation device 3. If the determination in S34 is YES, the process proceeds to S35, and in S35, an instruction to inspect the expansion tank 6 is transmitted to the service shop in charge, and the process proceeds to S36. Next, in S36, an instruction is transmitted to end the pressure measurement of the air chamber 6*a*, and the process ends. Upon receiving the instruction to end the pressure measurement of the air chamber 6*a*, the control unit 7 opens the closing valve 9*a* and closes the opening valve 9*c* so as to end the pressure measurement of the air chamber 6*a*.

The operation and effects of the hot water circulation device 3 and the hot water device monitoring system 20 will be described.

Since the hot water circulation device 3 measures the pressure in the air chamber 6*a* with the closing valve 9*a* closed and the opening valve 9*c* open, the pressure in the air chamber 6*a* may be measured with the expansion tank 6 disconnected from the hot water in the circulation passage 2 without interfering with the circulation of hot water. Moreover, when the measured pressure of the air chamber 6*a* is not within a predetermined pressure range, a warning notification of the pressure in the air chamber 6*a* is issued. As a result, since the circulation of hot water is not interfered, the chances of measuring the pressure in the air chamber 6*a* can be easily increased, and by detecting the failure of the expansion tank 6, the failure caused by the expansion tank 6 can be prevented.

The control unit 7 stores the periodically measured pressure of the air chamber 6*a* in the data storage unit 7*a*, compares the pressure measured this time with the previous pressure stored in the data storage unit 7*a*, and when this difference is equal to or higher than a predetermined allowable fluctuation value (predetermined value), issues a warning notification of the pressure in the air chamber 6*a*. If there is a sudden change in pressure such that the difference exceeds a predetermined value, it means that the pressure in the air chamber 6*a* has suddenly decreased, so it is assumed that the diaphragm 8 is damaged or the filling port 6*c* is open. Therefore, when the pressure difference between the previous time and this time is equal to or higher than a predetermined value, a warning notification of the pressure in the air chamber 6*a* may be issued to notify of the occurrence of failure in the expansion tank 6.

When issuing a warning notification because the pressure in the air chamber 6*a* is not within the predetermined pressure range or because the pressure in the air chamber 6*a* has suddenly decreased, the control unit 7 lowers the temperature of the hot water in the circulation passage 2 to alleviate the pressure rise in the hot water in the circulation passage 2, thereby continuing the circulation of the hot water. Therefore, the thermal expansion of the heated hot water can be suppressed to reduce the pressure in the circulation passage 2, and failures such as leakage of hot water and damage of the circulation passage 2 caused by the expansion tank 6 can be prevented without interfering with the use of hot water supply.

The hot water device monitoring system 20 includes the hot water circulation device 3 and the monitoring server 17, and the control unit 7 is communicably connected to the monitoring server 17 via the communication network 16. The control unit 7 transmits the measured pressure of the air chamber 6 to the monitoring server 17, and the monitoring server 17 accumulates the received pressure as pressure data. Based on the accumulated pressure data, the control unit 7 or the monitoring server 17 instructs the service shop to inspect the expansion tank 6 when the pressure in the air chamber 6 is not within the predetermined pressure range, thereby enabling a quick response.

The control unit 7 may also be communicably connected to the monitoring server 17 without going through the control device 15. Moreover, instead of the control unit 7, the hot water circulation device 3 may be configured with a control device 15 having the data storage unit as control unit, and the control device 15 may measure the pressure in the air chamber 6. The warning notification of the pressure in the air chamber 6 may also be repeated. Further, those skilled in the art may implement various modifications to the above embodiments without departing from the scope of the disclosure, and the disclosure includes such modifications.

What is claimed is:

1. A hot water circulation device, comprising:

a circulation passage for heated hot water; a circulation pump for circulating the hot water in the circulation passage; a closed expansion tank in which a water chamber communicating with the circulation passage and an air chamber filled with a predetermined pressure in an initial state are partitioned by a diaphragm; and a control unit for controlling circulation of the hot water, the hot water circulation device comprising:

an air chamber pressure sensor for detecting a pressure in the air chamber of the expansion tank; a closing valve for cutting off the water chamber from the circulation passage; and an opening valve capable of opening to an atmosphere from between the closing valve and the water chamber, wherein the control unit closes the closing valve and opens the opening valve during circulation of the hot water, detects the pressure in the air chamber by the air chamber pressure sensor, and issues a warning notification when the pressure in the air chamber is not within a predetermined pressure range.

2. The hot water circulation device according to claim 1, wherein the control unit comprises a data storage unit for storing the pressure in the air chamber measured periodically, compares a pressure measured this time with a pressure of previous time stored in the data storage unit, and issues a warning notification when a difference is equal to or higher than or a predetermined value.

3. The hot water circulation device according to claim 2, wherein the control unit lowers a temperature of the hot water in the circulation passage and continues circulation when issuing the warning notification.

4. The hot water circulation device according to claim 1, wherein the control unit lowers a temperature of the hot water in the circulation passage and continues circulation when issuing the warning notification.

5. A hot water device monitoring system, comprising:

the hot water circulation device according to claim 1 and a monitoring server, wherein the control unit of the hot water circulation device is communicably connected to the monitoring server via a communication network, transmits the detected pressure of the air chamber to the monitoring server, and accumulates it as pressure data in the monitoring server; and the control unit or the monitoring server instructs a service shop to inspect the expansion tank based on the pressure data when the pressure in the air chamber is not within the pressure range.

* * * * *